United States Patent [19]

Dingler et al.

[11] Patent Number: 5,069,360

[45] Date of Patent: Dec. 3, 1991

[54] SILVERWARE BASKET WITH CUTAWAY DIVIDER

[75] Inventors: Geoffrey L. Dingler; Wilbur W. Jarvis, both of St. Joseph Township, Berrien County, Mich.

[73] Assignee: Whirlpool Corporation, Benton Harbor, Mich.

[21] Appl. No.: 572,434

[22] Filed: Aug. 27, 1990

[51] Int. Cl.[5] ..... B65D 1/24

[52] U.S. Cl. ..... 220/501; 220/555; 220/488

[58] Field of Search ..... 220/554, 507, 501, 555, 220/486, 487, 488; 206/401

[56] References Cited

U.S. PATENT DOCUMENTS

| | | | |
|---|---|---|---|
| 1,835,555 | 12/1951 | Stocken | 220/487 |
| 3,897,885 | 8/1975 | Joyer | 220/555 |
| 4,143,764 | 3/1979 | Moss, III | 220/561 |
| 4,318,478 | 3/1982 | De Winter | 220/486 |
| 4,498,594 | 2/1985 | Eldor | 220/488 |
| 4,630,739 | 12/1986 | Levenberg | 220/561 |

*Primary Examiner*—Joseph Man-Fu Moy

[57] ABSTRACT

A silverware basket for use in a dishwasher, the silverware basket having a rear wall, a water previous front wall spaced from the rear wall, a water pervious bottom wall connecting the front and rear walls and a plurality of upper and lower dividers extending between the rear wall and the front wall to provide a substatially solid upper and lower barrier between the front and rear walls. The combination of the upper divider and lower divider define a substantially vertical plane or wall bounded by the rear wall, the bottom wall, the front wall and a top of the front wall, wherein a minority of an area of the plane or wall is solid. In the preferred embodiment, the dividers are formed integrally with and project from the rear wall toward and engage with the front wall. The lower divider is also formed integrally with the bottom wall.

6 Claims, 3 Drawing Sheets

SILVERWARE BASKET WITH CUTAWAY DIVIDER

BACKGROUND OF THE INVENTION

This invention relates to silverware baskets used in dishwashers, the baskets being of the type wherein the interior of the basket is divided into individual compartments.

The use of silverware baskets in dishwashers is well known. Generally the baskets have sufficient volume to hold a large number of pieces of silverware and are sub-divided into compartments by dividers to hold the silverware pieces in a generally vertical orientation. Walls of the basket are water-pervious to permit sprays of washing and rinsing liquid to impinge upon the silverware carried in the baskets and to drain away from the silverware, carrying foods particles therewith.

A particular style of silverware basket is disclosed in U.S. Pat. No. 3,665,953, assigned to the assignee of the present application, wherein the basket is comprised of a rear wall, sidewalls, a front wall and a bottom wall. The front wall is spaced from the rear wall by the side and bottom walls. A plurality of dividers project from the rear wall and extend to the front wall. The dividers also extend from the bottom wall to beyond the top of the front wall. The dividers each comprise a generally vertical sheet of material with a plurality of relatively small openings along a rear edge thereof to permit some liquid to pass from one compartment to another. The forward half of each of the dividers, however, is solid, thereby preventing passage of liquid at the front portion of the divider.

The washing and rinsing spray of water in a dishwasher is generally provided by a rotating spray arm which has one or more spray jets directed toward the area in which the silverware basket is positioned. In the arrangement wherein the silverware basket is positioned adjacent to or mounted on the openable door of the dishwasher, the use of solid wall dividers inhibits the free passage of wash and rinse water through the silverware basket and creates "shadow" areas which do not receive direct spray from the spray arm. Nevertheless, it is desirable to utilize dividers which extend between the front and rear walls and which provide a substantially solid horizontal barrier to prevent movement of silverware between the individual compartments.

U.S. Pat. No. 3,182,854 discloses the use of a silverware basket for a dishwasher which utilizes upper dividers which extend across the basket between opposing walls and sub-divide the basket into a number of compartments. At a bottom wall of the basket a plurality of upwardly extending projections in the form of tapered spikes provide a grid of discontinuous and relatively open dividers which would allow some movement of the silverware within and between the lower divider spikes. This movement of the silverware could cause increased noise levels during operation of the dishwasher.

SUMMARY OF THE INVENTION

The present invention provides a silverware basket in which the dividers are formed as upper and lower dividers which extend between the rear wall and the front wall to provide a substantially solid upper and lower barrier between the front and rear walls. The upper and lower dividers are sized and arranged such that the combination of an upper divider and a lower divider defines a substantially vertical plane bounded by the rear wall, the bottom wall, the front wall and a top of the front wall, wherein the minority of an area of the plane is solid. Thus, the dividers comprise vertical barrier walls extending from the bottom of the basket to the top of the top wall of the basket with a majority of the area of the wall being cut away or relieved.

In a preferred embodiment of the invention, both the upper dividers and lower dividers are formed integrally with and project from the rear wall and extend continuously to and engage the front wall. The lower dividers are also formed integrally with and project from the bottom wall. Also in a preferred embodiment of the invention the front wall is pivotally mounted to the bottom wall such that the front wall will pivot from a first closed position adjacent to the dividers to a second opened position downwardly and away from the dividers to provide access to an interior of the basket. There are also attachment means provided on the rear wall for mounting the basket in the dishwasher.

DETAILED DESCRIPTION OF THE PREFERRED EMBODIMENTS

Figure 1:
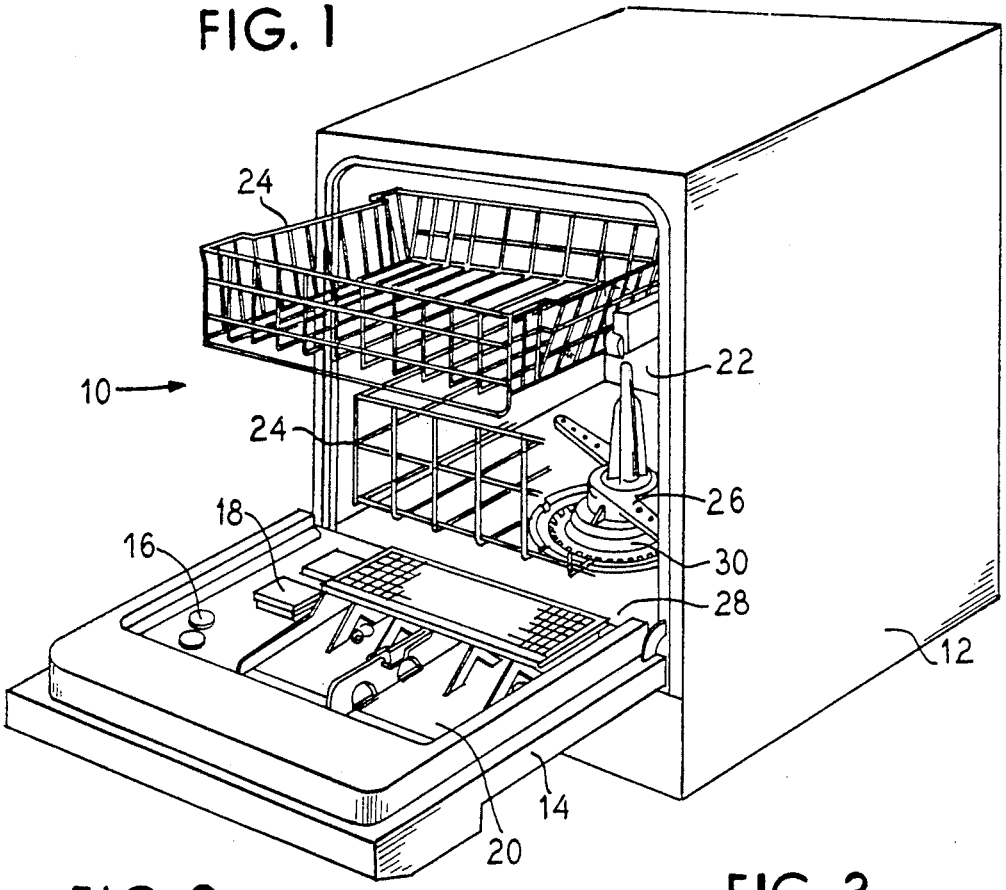
FIG. 1 is a perspective view of an automatic dishwasher in which the silverware basket of the present invention finds utility.

FIG. 1 shows a dishwasher 10 having a cabinet 12 and an openable door 14. The interior of the door carries a rinse additive dispenser 16, a detergent dispenser 18 and a removable silverware basket 20. A wash chamber 22 of the cabinet 12 houses dish supporting racks 24 and a rotating spray arm 26. Adjacent a floor 28 of the wash chamber 22 is a raised area 30 which houses a pump assembly (not shown) which directs wash liquid into the spray arm 26.

The silverware basket 20 which embodies the present invention is shown in greater detail in FIGS. 2–5. The embodiment of the dishwasher basket 20 illustrated is substantially similar to the construction disclosed in U.S. Pat. No. 3,665,943, the specification of which is incorporated herein by reference. Generally, the basket 20 is comprised of a rear wall 40, a liquid pervious front wall 42, a liquid pervious bottom wall 44 connecting the front and rear walls and side walls 46 which connect the front rear and bottom walls. In a preferred embodiment, the basket is constructed of molded plastic with the rear, bottom and side walls integrally formed. The actual construction of the front, rear, side and bottom walls can be substantially similar to that described in U.S. Pat. No. 3,665,943.

Figure 2:
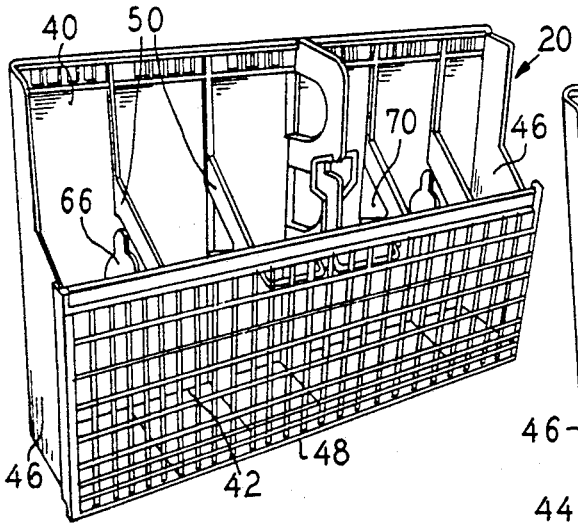
FIG. 2 is a perspective view of the dishwasher silverware basket of the present invention with the front wall in a closed position.
Figure 3:
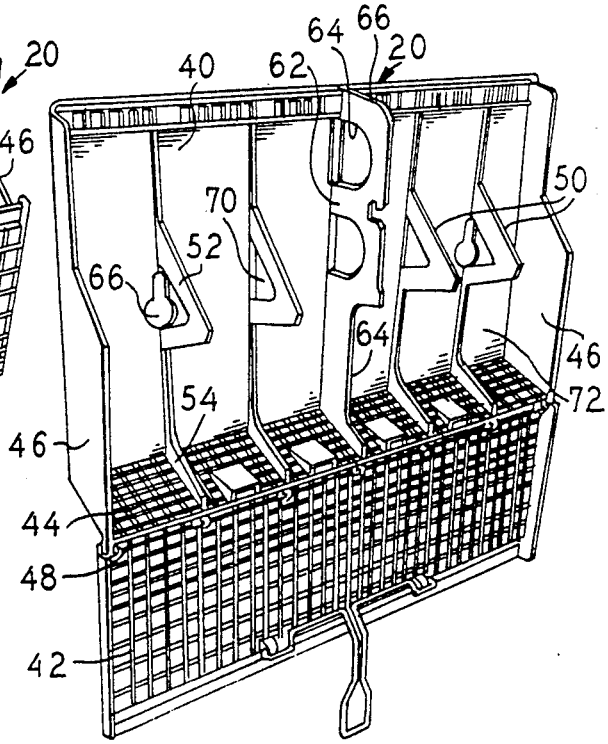
FIG. 3 is a perspective view of the silverware basket embodying the present invention with the front wall in an opened position.

The front wall 42 preferably is pivotally connected to the bottom wall 44 along a bottom edge 48 of the front wall 42 to permit the front wall to pivot from a first closed position with the front wall pressed against the side walls 46 (FIG. 2), to a second opened position downwardly and away from the side walls to provide access to an interior of the basket 20 (FIG. 3).

A plurality of vertical dividers 50 are provided in the interior of the basket which divide the interior into a plurality of laterally adjacent compartments.

Figure 6:
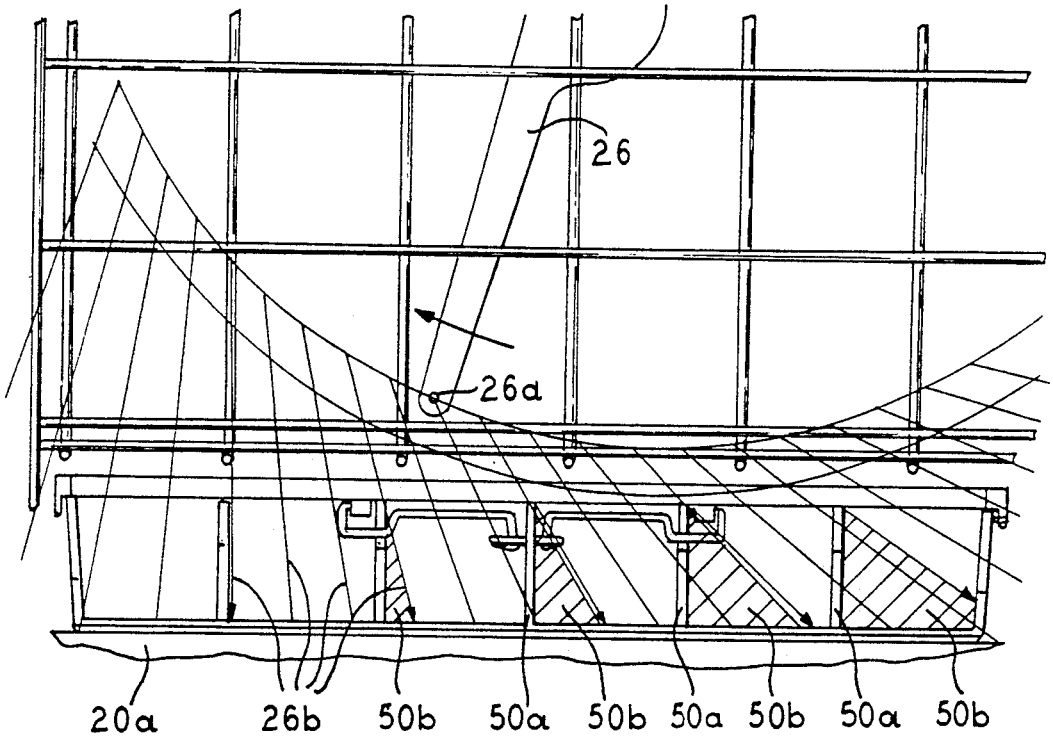
FIG. 6 is a partial top sectional view illustrating the position of the silverware basket relative to the rotating spray arm.

FIG. 6 illustrates the spray pattern generated within the wash chamber 22 of the dishwasher 10 by the rotating spray arm 26. A nozzle 26*a* on the spray arm directs wash and rinse water outwardly from the spray arm which wash and spray water is used to impinge against silverware articles carried in the silverware basket 20. The spray arm rotates in a clockwise direction as seen in FIG. 6 with the rotation provided by a reaction to the water leaving through various nozzles in the spray arm. Thus, the nozzles, or a majority thereof, are directed at least partially rearwardly so as to provide the forward rotation direction of the spray arm. Thus, an oblique spray pattern into the basket 20 results from the spray arm as illustrated by arrows 26*b*. With relatively solid vertical dividers 50*a*, as disclosed in U.S. Pat. No. 3,665,943, "shadow" areas of 50*b* of increasingly larger size, as one moves toward the right within the basket 20*a*, result. These "shadow" areas 50*b* do not receive the direct spray from the nozzle 26*a* and thus the cleaning effect of the spray is diminished. The relatively small openings in the divider walls along the rear wall of the basket disclosed in the '934 patent do not sufficiently reduce the "shadow" areas to provide the highest possible level of cleaning action. To address this problem and to reduce these "shadow" areas, Applicants have cut away or relieved large portions of the dividers such that a majority of the area defined by the dividers is open and only a minority of the area is solid.

The dividers 50 of the present invention are comprised of an upper divider projection 52 and a lower divider projection 54 such that a paired combination of an upper divider 52 and a lower divider 54 define a substantially vertical plane or wall bounded by the rear wall 40, the bottom wall 44, the front wall 42 and a top edge 56 of the front wall 42. What is critical to the present invention is that the area defined by such plane is largely cut away or relieved resulting in only a minority of the area of the plane being solid.

Another critical feature of the invention is that both the upper dividers 52 and lower dividers 54 extend between the rear wall and the front wall to provide a substantially solid upper barrier and a substantially solid lower barrier between the front and rear walls. By substantially solid it is meant that more than 50% of the horizontal extent between the rear wall and front wall is solid. While it can be appreciated that there may be provided one or more gaps in a barrier structure forming the upper or lower divider, it is important that the barriers be substantially solid so as to prevent movement of silverware articles from compartment to compartment during the washing process. Such movement could result in increased noise generation due to movement of the silverware articles hitting one another.

Figure 4:
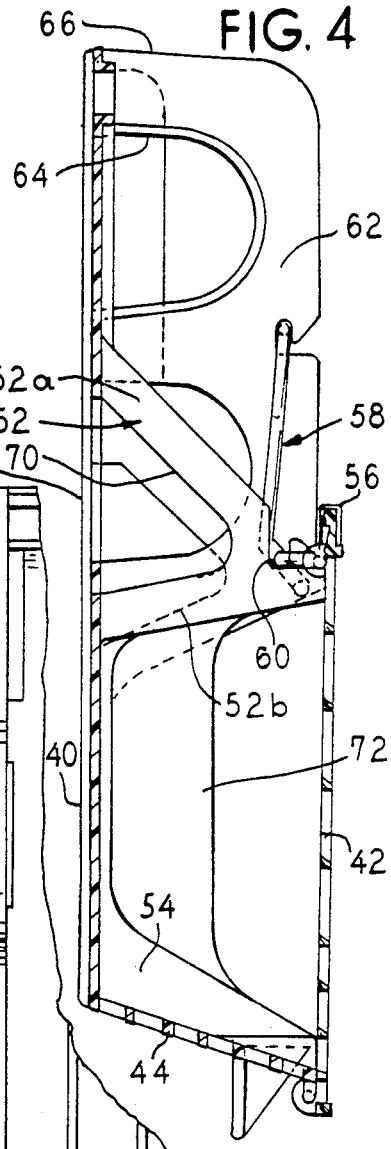
FIG. 4 is a side sectional view through the silverware basket illustrating the upper and lower dividers.
Figure 5:
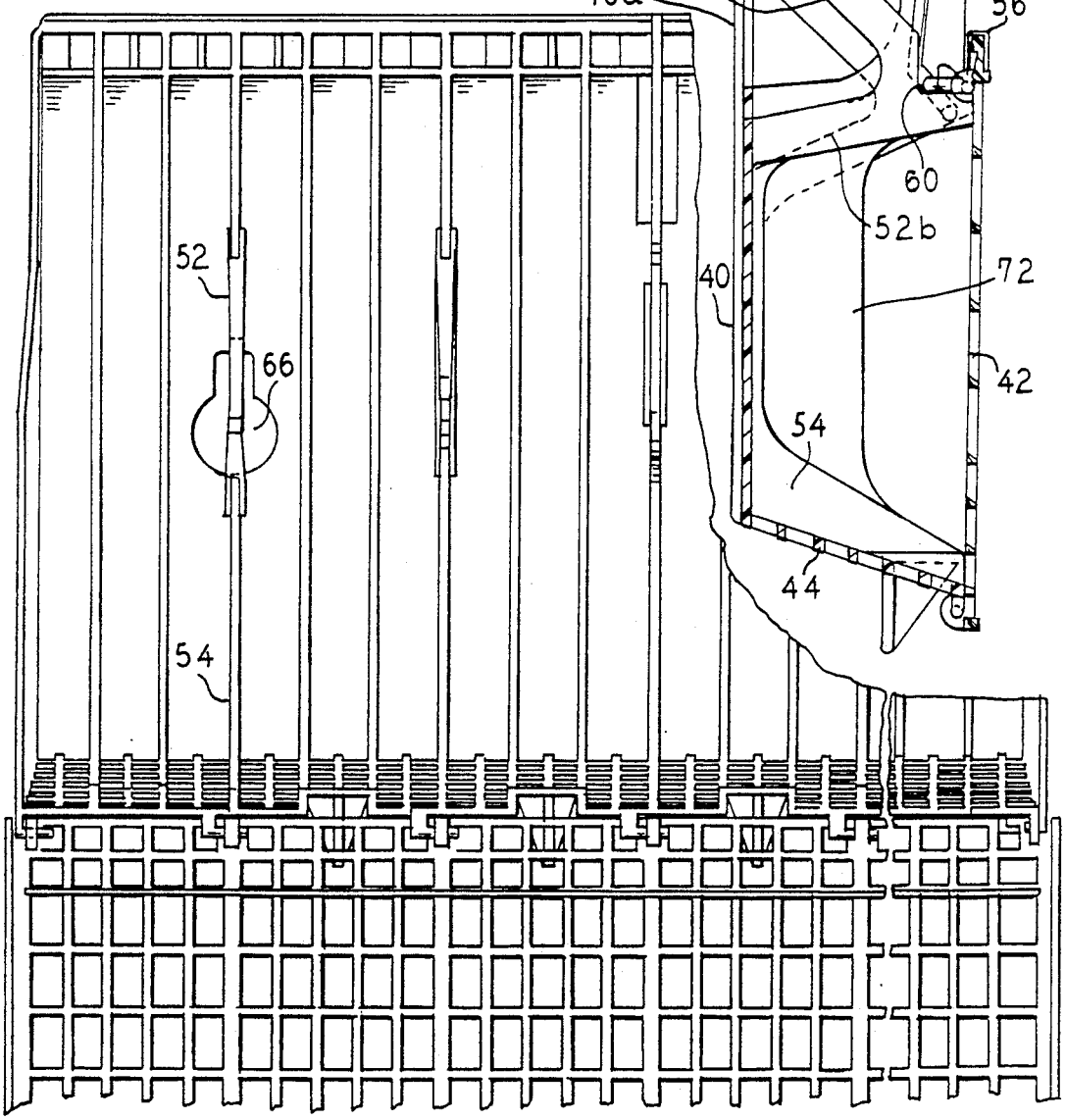
FIG. 5 is a front sectional view of the silverware basket showing the vertical alignment of the upper and lower dividers.

In the preferred embodiment illustrated, the upper 52 and lower 54 dividers are formed integrally with the rear wall 40 and continuously extend to and engage with the front wall 42 when the front wall 42 is in the closed position illustrated in FIGS. 2 and 4. A latching mechanism 58 in the form of a spring handle is mounted near the top edge 56 of the front wall 42 and is received in slots 60 in some of the upper dividers.

As best seen in FIG. 4, the upper divider projects from a medial portion 40*a* of the rear wall 40 and is comprised of two legs, leg 52*a* which is formed integrally with the rear wall 40 and projects forwardly and downwardly toward the front wall 42. A second, lower leg 52*b* is formed integrally with the rear wall 40 and projects forwardly and upwardly toward the front wall 42 where it joins the upper leg 52*a* to abut the front wall 42. The lower divider 54 comprises a single generally trapezoidal leg which is formed integrally with the rear wall 40 and bottom wall 44 and projects forwardly from the rear wall and upwardly from the bottom wall to the front wall in a downwardly sloping manner, following a downward slope of the bottom wall 44. The legs 52*a*, 52*b* define an open, cut-away or relieved area 70 along the rear wall 40. The leg 52*b* and lower divider 54 define an open, cut-away or relieved area 72 along the front wall 42 and extending back to the rear wall 40. The open areas 70, 72 comprise an area greater than that taken up by the solid portions of the divider legs 52*a*, 52*b*, 54 within the enclosed area of the basket, thus greatly enhancing the spray pattern within the basket over that previously available, yet assuring that the silverware contained within the basket will not be subject to excessive movement therein during the washing process.

A central wall 62 divides the basket 20 in half. The central wall 62 extends the full height of the rear wall 40 and includes one or more relieved areas 64 near a top end 66 thereof as finger holes to assist a person in removing the basket 20 from the dishwasher 10. The central wall 62 is also relieved along a lower front edge at 64 to provide enhanced cleaning of the silverware carried within the basket due to reduced "shadow" areas.

The rear wall 40 includes relieved keyways 66 by means of which the basket may be mounted within the dishwasher 10. Such mounting arrangement is described in greater detail in U.S. Pat. No. 3,665,943.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a silverware basket for use in a dishwasher, said basket having a rear wall with means thereon for mounting said basket in said dishwasher, a water-pervious front wall spaced from said rear wall, a water-pervious bottom wall connecting said front and rear walls, and side walls connecting said front, rear and bottom walls, with means for mounting said front wall on said bottom wall to pivot said front wall from a first closed position adjacent said side walls to a second open position downwardly and away from said side walls to provide access to an interior of said basket, the improvement comprising:

a plurality of upper dividers, each upper divider comprising a top leg formed integrally with said rear wall and projecting downwardly toward said front wall, a bottom leg formed integrally with said rear wall and projecting upwardly toward said front wall to join with said top leg, a plurality of lower dividers, each lower divider being vertically aligned with an upper divider and comprising a trapezoidal projection formed integrally with said rear and bottom walls and projecting forwardly from said rear wall and upwardly from said bottom wall toward said front wall;

each upper divider and lower divider pair defining a substantially vertical plane bounded by said rear wall, said bottom wall, said front wall and a top of said front wall, wherein a minority of an area of said plane is solid.

2. In a silverware basket according to claim 1, the further improvement wherein said upper dividers continuously extend a majority of the distance between said rear wall and said front wall.

3. In a silverware basket according to claim 1, the further improvement wherein said lower dividers continuously extend a majority of the distance between said rear wall and said front wall.

4. In a silverware basket according to claim 1, the further improvement wherein said upper dividers engage said front and rear walls.

5. In a silverware basket according to claim 1, the further improvement wherein said lower dividers engage said front and rear walls.

6. In a silverware basket according to claim 1, the further improvement wherein said upper dividers extend from a medial portion of said rear wall.

* * * * *